United States Patent [19]

Townsend

[11] Patent Number: 4,795,540

[45] Date of Patent: Jan. 3, 1989

[54] SLOTTED CATHODE COLLECTOR BAR FOR ELECTROLYTE REDUCTION CELL

[75] Inventor: Douglas W. Townsend, Glen Burnie, Md.

[73] Assignee: Comalco Aluminum, Ltd., Melbourne, Australia

[21] Appl. No.: 125,760

[22] Filed: Nov. 25, 1987

Related U.S. Application Data

[63] Continuation of Ser. No. 51,913, May 19, 1987, abandoned.

[51] Int. Cl.[4] ..... C25C 3/08; C25C 3/16

[52] U.S. Cl. ..... 204/243 R; 204/294

[58] Field of Search ..... 204/243 R–247, 204/294, 67

[56] References Cited

U.S. PATENT DOCUMENTS

| | | | |
|---|---|---|---|
| 3,156,639 | 11/1964 | Kibby | 204/243 R X |
| 3,179,736 | 4/1965 | Ramsey | 204/243 R X |
| 3,499,831 | 3/1970 | McMinn et al. | 204/243 R |
| 4,243,502 | 1/1981 | Kubler | 204/294 X |
| 4,287,045 | 9/1981 | Lechevallier et al. | 204/243 R |

*Primary Examiner*—Donald R. Valentine

*Attorney, Agent, or Firm*—Kenyon & Kenyon

[57] ABSTRACT

An electrolytic reduction cell for the production of aluminum having a slotted cathode collector bar. The slots are filled with insulating material thereby directing the electrical current flow through the cathode collector bar in a manner which reduces the horizontal current components in the cell.

25 Claims, 3 Drawing Sheets

SLOTTED CATHODE COLLECTOR BAR FOR ELECTROLYTE REDUCTION CELL

This application is a continuation, of application Ser. No. 051,913, filed May 19, 1987, now abandoned.

This invention relates generally to improvements in electrolytic cells, and more specifically, to improvements in the cathode collector bars of electrolytic reduction cells used in the production of aluminum.

BACKGROUND OF THE INVENTION

Aluminum is produced by the electrolytic reduction of alumina from an electrolyte. The electrolyte comprises primarily molten cryolite containing alumina and possibly other materials such as fluorspar, dissolved therein. The classic prebaked anode and Soderberg anode aluminum reduction cells comprise an anode structure suspended in a cryolite bath. Beneath the cryolite bath is a molten aluminum metal pad which forms the cathode and collects on the carbon blocks in the bottom of the cell.

The cathode blocks conduct the electric current from the molten metal pad to the external electric bus system of the cell. In a typical cathode design, multiple steel collector bars extend from the external bus bars through each side of the cathode shell into the carbon cathode blocks. The cathode collector bars are usually tightly attached to the cathode blocks with cast iron or carbon cement to enhance the electrical contact between the carbon cathode blocks and the cathode collector bars.

Modern aluminum manufacturing plants often have hundreds of electrolytic cells with over one-hundred cells connected in series. With such a large number of cells, cell maintenance is an ongoing operation involving numerous personnel and heavy equipment, such as cranes, to move the heavy carbon cathode blocks and cathode collector bars. Aluminum reduction cells of this type are operated at low voltages (e.g. 4–4.5 volts) and high currents (e.g. 70,000–275,000 amps). The current enters the reduction cell through the anode structure and then passes through the cryolite bath, down through the molten aluminum pad where it then enters the carbon cathode blocks and is carried out of the cell by the cathode collector bars.

As the electrolyte bath is traversed by electric current, alumina is reduced electrolytically to aluminum at the cathode, and carbon is oxidized to carbon dioxide at the anode. The aluminum thus produced, accumulates in a molten aluminum pad and, in a conventional cell, is tapped off periodically.

The alumina-cryolite bath is typically maintained on top of the metal pad at a set depth. There is a voltage loss as the current passes through the cryolite bath. This voltage loss is directly proportional to the length of the current path and is typically about 1 volt per inch of gap between the anode and molten aluminum pad, i.e. the interpolar distance. Therefore, any restriction on the reduction of the anode to cathode spacing restricts the achievement of maximum power efficiency and limits the ability to improve the electrolytic cell operation. The molten aluminum pad acts as a liquid metal cathode in common commercial cells.

Commercial aluminum reduction cells are generally operated by maintaining a minimum depth of liquid aluminum on the floor of the cell which is "seen" by the bath as the true cathode. This minimum aluminum depth is usually at least 2 inches and may be 20 inches.

The high currents passing through the electrolytic cell produce powerful magnetic fields that induce excessive circulation in the molten aluminum pad leading to problems such as reduced electrical efficiency and "back reaction" of the molten aluminum with the electrolyte.

The flow of electrical current through the aluminum pad and carbon cathode naturally follows the path of least resistance. The electrical resistance in a conventional cathode collector bar is proportional to the length of the current path from the point at which electric current enters the cathode collector bar to the nearest external bus. As generally depicted in FIG. 1, the lower resistance of the current path starting at points on the cathode collector bar closer to the external bus causes the flow of current through the molten aluminum pad and carbon cathode blocks to be skewed in that direction. The horizontal components of the flow of electric current interact with the vertical component of the magnetic field, adversely affecting efficient cell operation. These interactions increase the motion of the metal pad, sometimes violently stirring the molten pad and generating vortices, and causing localized electrical shorting to the anode. The magnetic fields also lead to unequal depths in the molten aluminum pad and the cryolite bath.

Metal pad turbulence can also increase the "back reaction", or reoxidation, of cathodic products, thereby lowering cell efficiency. Furthermore, metal pad turbulence tends to accelerate distortion and degradation of the cathode bottom liner through attrition and penetration of the cryolite.

The depth variations also restrict the reduction of the anode to cathode gap and produce a loss in current efficiency since power is lost to the electrolyte interposed between the anode and cathode blocks. Movement of the molten aluminum metal pad also tends to cause uneven wear on the carbon cathode blocks and may result in early cell failure.

It is possible to reduce molten aluminum metal pad stirring by modifying the bus system on an existing cell line to reduce the overall magnetic effects. However, it is normally very expensive to modify the bus system.

In recognition of the adverse effects that horizontal current components have on cell efficiency, cell designs have been proposed which attempt to reduce the horizontal component of current by changing the basic design of the cathode collector bars. The proposals found in the literature, however, often fail to account for the practical necessity of preassembling cathode blocks onto the iron collector bars so that the carbon cathode blocks can be reassembled in the bottom of the cell. They also fail to provide designs which are amenable to safe handling by maintenance crews using heavy equipment such as cranes.

One example of a design of an aluminum reduction cell which attempts to increase cell efficiency by reducing horizontal current components is found in U.S. Pat. Nos. 4,194,959 to Hudson, et al. and 4,592,820 to McGreer. The Hudson et al. patent teaches the use of one or more collector bars. Each collector bar is provided with one or more connector bars. The connector bars carry the current from the collector bars to the external bus system. The connector bars are of a lighter gauge material than the collector bars and are connected to the collector bars at points distant from the ends of the collector bars. The resistances of the disclosed connector bars are chosen so that preselected currents are drawn from each corresponding collector bar section. This design fails to account for the practical necessity of preassembling cathode blocks onto the iron collector bars so that the cathode shells can be relined. In addition, this design calls for major changes in the design of conventional cathode bars mandating a new cathode shell and current bus requiring major capital investments. Such a design would also be inherently weak due to the lighter gauge material used in the connector bars and probably could not safely be handled by workers and cranes during maintenance operations.

U.S. Pat. No. 2,528,905 of Ollivier, et al. teaches disposing "current lead bars" perpendicular to the bottom of the electrolytic cell. This design, which necessitates providing passages through other portions of cell lining, i.e. the concrete vault and the layer of insulating bricks, would require extensive capital expenditures since it entails a significant departure from the conventional rectangular-block collector bar design.

U.S. Pat. No. 3,787,311 to Wittner et al. attempts to equalize the current flow through the cell bottom by providing a plurality of carbon blocks with different resistivities. The carbon blocks are arranged such that blocks with higher resistivities are closer to the sides of the cell where the current flow would otherwise be greater. It is generally known to those skilled in the art that high resistivity blocks will convert to lower resistivity blocks during the high operating temperatures. Accordingly, the use of different resistivity blocks does not provide the desired result.

U.S. Pat. No. 2,868,710 to Pontremoli discloses a design modification for the cathodic bottom of electrolysis furnaces which results in a portion of the (cathode) block being situated under the cathode conductor (collector bar). This design would provide a cell that is very difficult to construct and maintain in comparison to typical cells wherein the carbon cathode blocks are provided with grooves that allow the relatively simple lowering of the carbon cathode block onto the cathode collector bar for subsequent sealing.

Prior attempts to solve the recognized current distribution problem in aluminum electrolytic reduction cells fail to proiide a practical design which can be implemented without major capital expenditures and which is safe to handle by maintenance operators using heavy equipment.

The present invention provides a more practical approach by using specifically-designed cathode collector bars to minimize the horizontal electrical currents in the metal pad. The improved cathode collector bar of the present invention is advantageously employed in existing cell designs using standard carbon cathode blocks or carbon cathode blocks having new improved molten alumina wettable surfaces such as described in U.S. Pat. No. 4,526,911 to Boxall et al. The improved collector bar design of the present invention can also be advantageously employed in new low energy, drained sloped cathode cells such as described in U.S. Pat. No. 4,602,990 to Boxall et al.

OBJECTS OF THE INVENTION

It is therefore an object of the present invention to improve the design of elecrolytic reduction cells by improving the cathode collector bar design to obtain a more uniform current distribution across the cathode bottom.

It is a further object of the present invention to provide uniform current distribution through an aluminum electrolytic reduction cell by making only minor modifications to cathode collector bars entering the side of the cell and embedded in the carbon cathode blocks.

It is another object of the present invention to produce preassembled cathode structures resulting in more uniform current distribution in an aluminum reduction cell that can also safely be handled by workers using heavy equipment, such as cranes, during relining operations.

It is yet a further object of the present invention to provide such an improved cathode collector bar design which can be used with existing conventional cathode shells and external current buses.

These and other objects of the present invention will become apparent from the following description and claims in conjunction with the drawings.

SUMMARY OF THE INVENTION

The present invention may be generally summarized as an electrolytic reduction cell for the production of aluminum comprising two external walls. External bus bars are positioned adjacent to the two external cell walls and at least one anode is supported in the cell between the cell walls. A carbonaceous cathode block is disposed below the anode and extends between the cell walls. A cathode collector bar having a top side, a bottom side, and a longitudinal axis is disposed in electrically conductive contact with the cathode block and extends from the first cell wall to at least near to the cell center. The cathode collector bar is electrically connected to the first external bus bar. The cathode collector bar has a slot disposed therein; the slot having a first portion extending from near the first cell wall toward the cell center approximately parallel to the cathode collector bar longitudinal axis and terminates at a first interior end between the first cell wall and the cell center. The slot has a second portion extending downwardly from the top of the cathode collector bar at a location between the first cell wall and the cell center and intersects the first slot portion. Insulating material is disposed in the first and the second slot portions.

DETAILED DESCRIPTION

Figure 1:
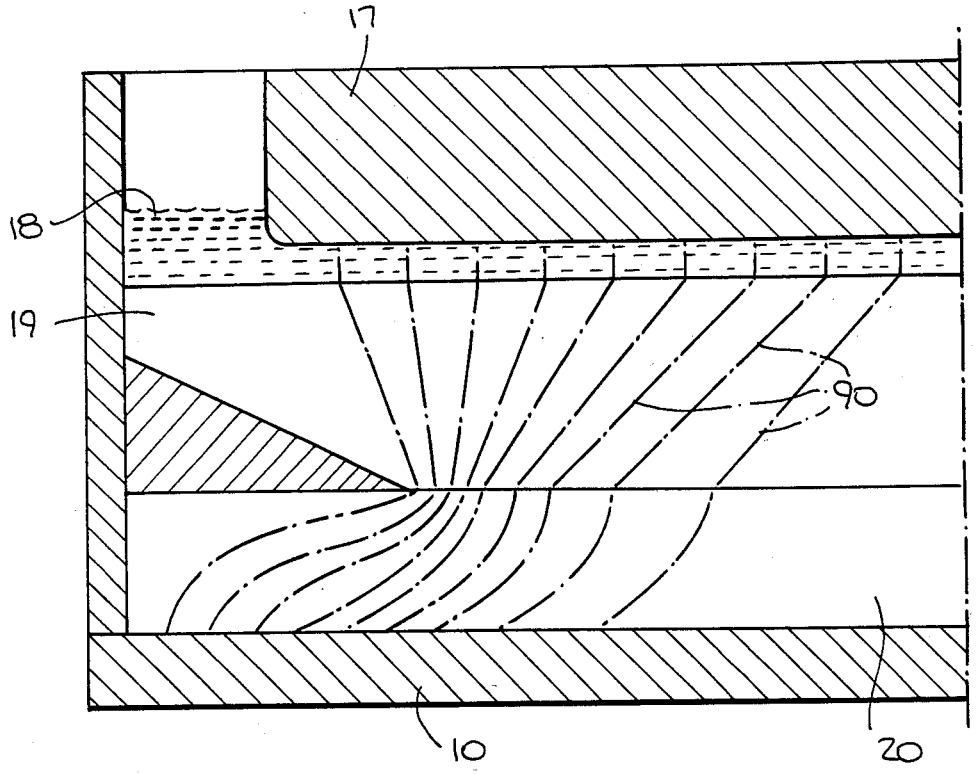
FIG. 1 schematically illustrates in cross-section the flow of current through a portion of an aluminum electrolytic reduction cell employing a conventional cathode collector bar having a solid, rectangular cross-section.

FIG. 1 illustrates the electrical current flow through an aluminum reduction cell having a conventional cathode collector bar (10). The electrical current enters the cell through the anode (17), passes through the electrolytic bath (18) and the molten aluminum pad (19). The electrical current then enters the carbon cathode blocks (20) and is carried out of the cell by the cathode collector bar (10). As illustrated (by lines 90) the electrical current is skewed toward the end of the cathode collector bar (10) closest to the external bus (not shown).

Figure 2:
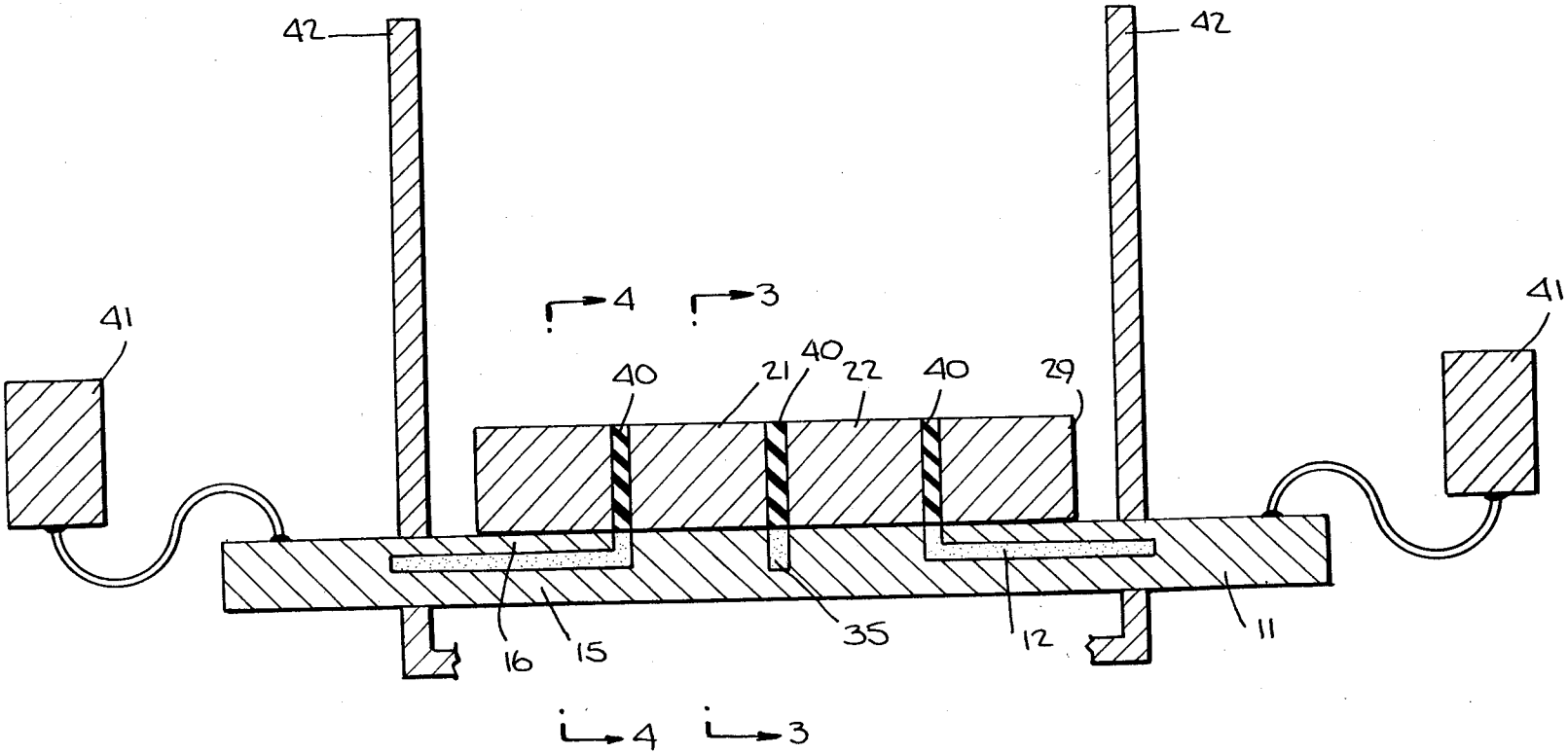
FIG. 2 schematically illustrates a longitudinal cross-sectional view of one embodiment of the cathode collector bar of the present invention installed in an aluminum reduction cell with parts removed.

A cathode collector bar typically has a rectangular cross section and is fabricated from steel. With reference to FIG. 2, the present invention comprises an improved electrolytic reduction cell by providing a cathode collector bar (11) having slots (12) which direct the flow of current through the electrolytic reduction cell in such a way as to minimize the horizontal components of the current flow. Slots (12) are formed in the cathode collector bar (11) by any suitable method such as flame cutting. The slots (12) extend vertically downward from the top of the cathode collector bar (11), which is in contact with the carbon cathode blocks, into the cathode collector bar (11) and horizontally, advantageously parallel to the longitudinal axis of the cathode collector bar, in a direction away from the center of the cathode collector bar, i.e. toward the nearest end of the cathode collector bar (11) connected to an external bus 41. The slots can range in size, but preferably have a width equal to the width of the collector bar and preferably have a vertical height of at least 1 inch.

The horizontal portion of the slots (12) preferably extends beyond the end (29) of the corresponding cathode block closest to the external bus system (60), and most preferably, beyond the outer shell (42) of the cell and at least partially underneath any other electrically conductive carbonaceous cathode material. The vertical portion of the slots (12), which typically defines the position of the end of the horizontal slot portion closest to the center of the cell, is suitably located from about $\frac{1}{4}$ to about $\frac{3}{4}$ of the distance and is preferably located from $\frac{1}{2}$ to $\frac{3}{4}$ of the distance from the end (29) of the corresponding cathode block closest to the external bus system, to the center of the cell.

Figure 4:
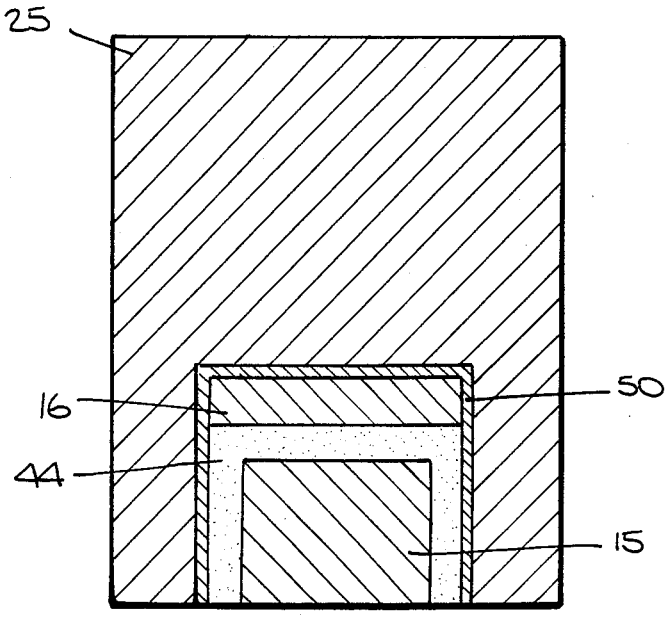
FIG. 4 is a schematic cross-section view of the embodiment of the cathode collector bar of the present invention illustrated in FIG. 2 along line A—A.

The vertical and horizontal portions of the slots are filled with a refractory cement which, as will be appreciated by those skilled in the art, has a higher electrical resistance than the steel cathode collector bar (11) and therefore acts as an insulator. An example of a suitable refractory cement is PG-23 ES "Extra Strength Castable" made by the Pryor-Giggey Co., P.0. Box 739, Whittier, Calif. 90608. The refractory cement filled slots (12) prevent the flow of current from the larger section (15) of the cathode collector bar which is below the slot (12), to the smaller section (16) of the cathode collector bar (11) which is above the refractory filled slot (12). To maintain proper electrical separation between the smaller sections (16) and the larger sections (15), the sides of the larger sections (15) may be reduced by machining, e.g., approximately 1 inch from each side, and filling the resulting void with insulating material, such as refractory cement (44), as shown in FIG. 4. Alternatively, it may be desired to maintain the original width of the larger sections (15) and remove portions of the cathode blocks adjacent the larger sections (15), and fill the resulting voids with an insulating material such as refractory cement.

Figure 3:
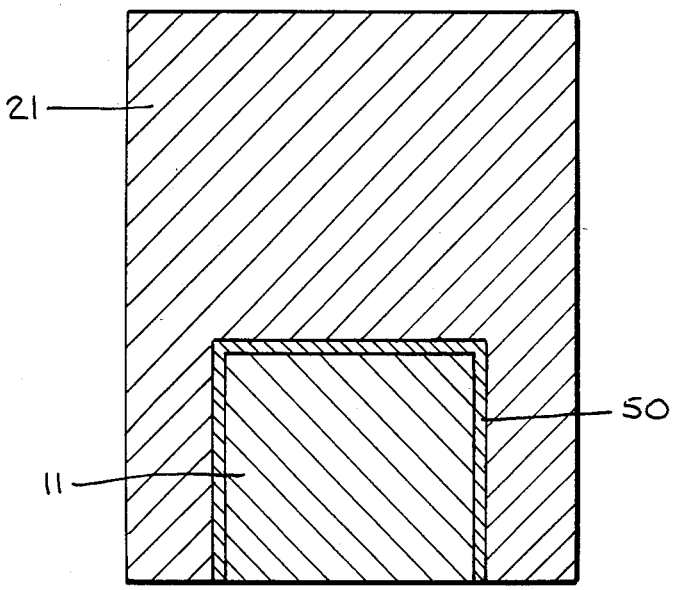
FIG. 3 is a schematic vertical cross-sectional view of the embodiment of the cathode collector bar of the present invention illustrated in FIG. 2 along line B—B.

The outer cathode blocks (25, 26) make electrical contact with the cathode collector bar at only the smaller sections (16) of the cathode collector bar above the horizontal slot via, e.g., a cast iron connection (50). See FIG. 4. The inner cathode blocks (21, 22) make contact with the entire cathode collector bar (11) as illustrated in FIG. 3 by connection thereto e.g., by using cast iron (50). The current flowing from the inner blocks is therefore carried by a relatively large cross-sectional area and, despite the longer current path from the inner cathode blocks to the external bus system (41), has an electrical resistance preferably approximately equal to the shorter current path of the smaller sections (16) of the cathode collector bar. The increased cross-sectional area of the longer current path is achieved at the expense of the shorter path. The relative cross-sectional areas provided by the slotted collector bar are designed to balance the current distribution between the cathode blocks. FIGS. 3 and 4 illustrate the cross-sectional areas of the carbon cathode blocks and the cathode collector bar along lines B-B and A-A, of FIG. 1, respectively.

In the embodiment, as shown in FIG. 2, four cathode blocks are used in conjunction with a cathode collector bar having two slots. The two inner blocks (21 and 22) electrically contact the unslotted portions of the cathode collector bar and the two outer cathode blocks (25 and 26) electrically contact the corresponding smaller portions (16) of the cathode collector bar provided by the slots (12).

The cathode blocks are separated by ram joints (40) which are typically made from calcined anthracite and coal tar pitch. The electrical resistivity of the baked ram joint is typically about five times that of the semi-graphitic cathode block material so that outward horizontal electrical currents in the cathode block ram joint structure are discouraged in favor of electrical current flowing downward into the collector bar which typically has approximately only one-third the electrical resistivity of the semi-graphitic cathode block.

In addition to the two slots previously described, a vertical slot (35) may advantageously be cut in the center of the cathode collector bar. The vertical slot (35), which may extend more than halfway through the cathode collector bar (11), is filled with an insulating material. This vertical slot (35) therefore creates an electrical resistance, causing most of the current flowing into the cathode collector bars to flow toward the external bus (41) located at the nearest side of the cell. This gives a better overall current distribution both within the cell and in the adjoining current bus of the plant. It also contributes to lower overall magnetic fields, less pad stirring, and better cell performance.

In the preferred embodiments, the ratio of the cross-sectional area of the larger section (15) of the cathode collector bar to the smaller section (16) is advantageously between 1.5:1 and 3:1 and preferably between about 1.8:1 and 2.8:1.

Estimates have been made of the overall decrease in cathode voltage loss for anthracitic cathode blocks when the following cathode collector bar cross-sections are used: in a cell having 52 cathode blocks set on 13 collector bars operated at a current of 105,000 amps, with the smaller section (16) of the cathode bar having a cross-section of 5.2 inches by 5.2 inches and the larger portion (15) having a 13.8 inch by 5.2 inch cross-section, a savings of 0.190 volts could be achieved; and with 2.25 inch by 5.2 inch and 4.25 inch by 5.2 inch respective cross-sections, a savings of 0.036 volts could be achieved.

As stated above, when the width of the larger section (15) is equal to the width of the smaller section (16), it is necessary to remove a portion of the cathode block adjacent to the larger section (15) and fill the void with an insulating material. As will be appreciated by those skilled in the art, this is necessary to prevent the flow of current from the outer blocks (25, 26) to the larger section (15). The amount of cathode block removed from each side and filled with insulating material is advantageously about 1 inch.

Within the bottom of the carbon cathode, the cathode blocks are joined to the cathode collector bar by a highly conductive material (50) such as cast iron, carbon cement, or the like (as shown in FIGS. 3 and 4).

The present invention is not restricted to cathode blocks constructed of segmental blocks as illustrated in FIG. 2. Each collector bar may have from one to five or more carbon cathode blocks attached to it. It is also possible to replace the single cathode collector with two cathode collector bars which meet near the center of the cell and suitably are separated by an insulating material. The beneficial effects of the slotted cathode collector bar will be achieved in each case by constructing the bar so that the larger section electrically contacts that part of the cathode block or blocks toward the center of the cell which the smaller section contacts the portion of the block or blocks toward the outside of the cell.

The present invention has the potential for near term energy savings of 3 to 4% (0.2 to 0.3 kWh/lb of aluminum) in conventional cells as well as in future applications in newer "drained-cathode" cell designs having sloped cathodes.

The present invention leads to reduced energy consumption without sacrificing the strong beam unit of cathode blocks that may be safely handled by cell maintenance crews. The cathode designs of the present invention reduce energy consumption by creating a more uniform current distribution between the molten aluminum pad and the cathode blocks. The present invention overcomes problems associated with conventional cell designs wherein the electrical current is skewed toward the outside of the outer row of blocks, causing large horizontal electrical currents in the aluminum pad, potentially violent stirring of the pad, the generation of vortices and localized shorting to the anode.

It will be understood to those skilled in the art that variations of the present invention are possible without departing from the spirit and scope of the present invention. While several embodiments have been described herein, the scope of the present invention is not limited thereby, but is defined by the following claims.

I claim:

1. An electrolytic reduction cell for the production of aluminum comprising:

a first cell wall and an opposite second cell wall with a cell center therebetween, a first external bus bar adjacent said first cell wall and a second external bus bar adjacent said second cell wall;

at least one anode;

means supporting said anode in said cell between said cell walls;

a carbonaceous cathode block disposed below said anode and extending between said cell walls;

a cathode collector bar having a top side, a bottom side, and a longitudinal axis disposed in electrically conductive contact with said cathode block and extending from said first cell wall to at least near to said cell center and electrically connected to said first external bus bar;

said cathode collector bar having a slot disposed therein, said slot having a first portion extending from near said first cell wall toward said cell center approximately parallel to said cathode collector bar longitudinal axis and terminating at a first interior end between said first cell wall and said cell center, and said slot having a second portion extending downwardly from said top of said cathode collector bar at a location between said first cell wall and said cell center and intersecting said first slot portion; and insulating material disposed in said first and said second slot portions.

2. An electrolytic reduction cell according to claim 1 wherein said second slot portion is approximately perpendicular to said collector bar longitudinal axis and intersects said first slot portion near said interior end.

3. An electrolytic reduction cell according to claim 2 wherein said second slot portion is located about $\frac{1}{4}$ to about $\frac{3}{4}$ the distance from said first cell wall to said cell center.

4. An electrolytic reduction cell according oo claim 3 wherein said first slot position divides said cathode collector bar into an upper section and a lower section and the cross-sectional area of said lower section is between about 1.5 to about 3 times greater than the cross-sectional area of said upper section.

5. An electrolytic reduction according to claim 4 wherein said lower section is electrically insulated from said cathode block.

6. An electrolytic reduction cell according to claim 4 wherein the cross-sectional area of said lower section is between about 1.8 to about 2.8 times greater than the cross-sectional area of said upper section.

7. An electrolytic reduction cell according to claim 2 wherein said second slot portion is located about $\frac{1}{2}$ to about $\frac{3}{4}$ the distance from said first cell wall to said cell center.

8. An electrolytic reduction cell according to claim 1 wherein said cathode collector bar extends from said first cell wall to said second cell wall and further has a second slot disposed therein;

said second slot having a first portion extending from near said second cell wall toward said cell center approximately parallel to said cathode collector bar longitudinal axis and terminating at a second interior end between said second cell wall and said cell center; and said second slot having a second portion extending downwardly from said top of said cathode collector bar at a location between said second cell wall and said cell center and intersecting said first slot portion of said second slot; and insulating material disposed in said first and said second slot portions of said second slot.

9. An electrolytic reduction cell as in claim 1 wherein said cathode block has four carbonaceous cathode blocks.

10. An electrolytic reduction cell according to claim 9 wherein said carbonaceous cathode blocks are separated by ram joints.

11. An electrolytic reduction according to claim 1 wherein said cathode collector bar extends from said first cell wall to said second cell wall and further has an additional vertical slot disposed therein near the center of said cell;

said additional vertical slot extending downwardly from said top side of said cathode collector bar; and wherein said additional vertical slot is filled with an electrically insulating material.

12. An electrolytic reduction cell according to claim 11 wherein said vertical slot extends more than half the distance from said top side to said bottom side.

13. An electrolytic reduction cell as in claim 1 wherein said cathode block comprises a plurality of individual cathode blocks.

14. An electrolytic reduction cell as in claim 1 wherein said first slot portion is parallel to said cathode collector bar longitudinal axis.

15. An electrolytic reduction cell as in claim 1 wherein said second slot portion is perpendicular to said cathode collector bar longitudinal axis.

16. An electrolytic reduction cell as in claim 1 wherein said surface of said cathode block facing said anode is a sloped surface.

17. An electrolytic reduction cell having an anode, at least one carbonaceous cathode block and a cathode collector bar, the improvement comprising:

at least one slot in said cathode collector bar, said slot being filled with an electrically insulating material and thereby defining two sections for the transfer of electrical current.

18. An electrolytic reduction cell as in claim 17 wherein said slot defines a smaller portion and a larger portion, said larger portion electrically contacts an inner part of said cathode block and said smaller portion electrically contacts an outer part of said cathode block.

19. An electrolytic reduction cell as in claim 18 wherein said larger and smaller portions approximately equalize the flow of electrical current through said inner part and said outer part.

20. An electrolytic reduction cell as in claim 18 having two slots wherein said inner parts of said cathode blocks are in electrical contact with said larger portions of said cathode collector bar and said outer parts of said cathode blocks are in electrical contact with said smaller portions of said cathode collector bar.

21. An electrolytic reduction cell as in claim 18 wherein the ratio of the respective cross-sectional areas of said smaller portion to said larger portion is in the range of between about 1:1.5 to about 1:3.

22. An electrolytic reduction cell as in claim 18 wherein the ratio of the respective cross-sectional areas of said smaller portion to said larger portion is in the range of between about 1:1.8 to about 1:2.2

23. An electrolytic reduction cell as in claim 17 wherein said cathode block comprises four carbon cathode blocks; two of said blocks being inner blocks and two of said blocks being outer blocks.

24. An electrolytic reduction cell as in claim 20 wherein said carbon cathode blocks are separated by ram joints.

25. An electrolytic reduction cell as in claim 17 wherein said cathode collector bar has two slots.

* * * * *